United States Patent [19]

Curro, Jr.

[11] Patent Number: 4,516,892

[45] Date of Patent: May 14, 1985

[54] PROTECTOR FOR THE CORE AND ADJACENT EDGES AND FACE PORTIONS OF A COIL OF MATERIAL

[75] Inventor: Dominic Curro, Jr., Mason, Ohio

[73] Assignee: Loroco Industries, Inc., Cincinnati, Ohio

[21] Appl. No.: 490,961

[22] Filed: May 2, 1983

[51] Int. Cl.[3] ..... B65D 85/66; B61D 45/00

[52] U.S. Cl. ..... 410/155; 206/413; 229/5.5

[58] Field of Search ..... 206/413, 414, 415, 416; 229/5.5, 5.8; 242/68.5, 68.6; 410/121, 154, 155, 156

[56] References Cited

U.S. PATENT DOCUMENTS

| | | | |
|---|---|---|---|
| 542,748 | 7/1895 | Duval | 206/414 |
| 1,377,154 | 5/1921 | Flynn | 206/415 X |
| 2,883,045 | 4/1959 | Abramson | 229/5.5 X |
| 3,229,887 | 1/1966 | Fehres et al. | 229/5.5 |
| 3,942,638 | 3/1976 | Stone | 206/416 |

*Primary Examiner*—Robert B. Reeves

*Assistant Examiner*—David F. Hubbuch

*Attorney, Agent, or Firm*—Frost & Jacobs

[57] ABSTRACT

A protector for the core, and adjacent edges and face portions of a coil of material, such as steel, is provided. The protector comprises first and second substantially identical discs each having an outer annular portion, an inner annular portion and a central aperture forming a circular inner edge. The outer annular portions of the two discs are joined together. The inner annular portions of the first and second discs having cuts therein extending transversely from the inner circular edges and forming a plurality of tabs capable of being bent at a substantially right angle to the outer annular portions. All of the tabs of the first disc of the protector are cut at the same angle. All of the tabs of the second disc of the protector are similarly cut at an equivalent but opposite or reverse angle. When the tabs are positioned at a substantially right angle to their respective outer annular portions, they form a continuous band of tabs capable of protecting the core of the coil of material while the joined outer annular portions of material prevent damage to the adjacent edges and face portions.

9 Claims, 6 Drawing Figures

PROTECTOR FOR THE CORE AND ADJACENT EDGES AND FACE PORTIONS OF A COIL OF MATERIAL

SUMMARY OF THE INVENTION

The present invention relates to protectors for coils or rolls of material such as steel. More particularly, the invention concerns fiberboard protectors positionable within the core or eye of a coil of material to protect the core and the adjacent edges of the material during the handling, storage, and transportation of the coil.

During the manufacturing process, materials such as steel are formed into coils by being wound about the mandrel of a coiling mechine. When removed from the mandrel of the coiling machine, the coil is characterized by a hollow core or eye defined by the innermost convolution of the coil. For example, steel is often produced in coils weighing approximately 30 tons. Coiled steel generally is thin, soft and pliable so as to allow it to be drawn and formed into various shapes during use.

Due to its heavy weight, a steel coil is usually lifted and moved by inserting a tool, such as a "C" hook or a roll clamp, into the core of the coil. Additionally, during the transportation of the coil, a binder chain or band is wrapped through the core and about the coil to prevent it from unwinding. Although these tools and binders are effective in lifting and transporting the steel coil, unfortunately they mar and damage the thin soft metal of the coil at the core and adjacent edges. Similarly, if other materials, such as aluminum or copper, are coiled, the hooks and clamps likewise scratch the core and adjacent edges of the coils. When the steel or coiled material is later used, waste and imperfections result due to such damage.

The present invention provides a protector capable of preventing damage to the core, and adjacent edge and face portions of a coil of material during handling, storage and transportation. The protector eliminates waste and damage arising from the marring and scratching of the core and adjacent edges by the handling tools and implements which are passed through the core of the coil. The protector allows the coiled material to be delivered to the work site free of such damage.

In the preferred embodiment, the protector includes two substantially identical discs each having an outer annular portion, an inner annular portion and a central aperture. The two discs are joined together along their outer annular portions. Various means, such as glue or adhesive, may be used to join the discs together. The inner annular portion of each disc is provided with a plurality of transverse cuts dividing the inner annular portion into a plurality of tabs. The tabs are capable of being bent at a substantially right angle relative to the outer annular portion of each disc. The tabs of the two discs are bent in the same direction. All of the tabs of a first disc of the protector are cut at the same angle. All of the tabs of the second disc of the protector are similarly cut at an equivalent but opposite or reverse angle. When the tabs of the two discs of the protector are bent at a substantially right angle relative to their respective outer annular portions, they form a continuous annular band of tabs. The band of tabs of the protector does not contain any void spaces between the tabs. The formed band of tabs of the protector is capable of being inserted within the core of a coil of material so that the band of bent tabs prevents damage to the core of the coil and the joined outer annular portions of the protector preserve the adjacent edges and adjacent face portions of the coil.

DETAILED DESCRIPTION OF THE INVENTION

In all of the Figures like parts have been given like index numerals. Referring to FIGS. 1 through 5, protector 5 of the present invention comprises two substantially identical circular discs 6*a* and 6*b* joined together. Disc 6*a* has an annular outer portion 7*a*, an inner annular portion 8*a* and a central aperture 9*a*. Disc 6*b* similarly has an annular outer portion 7*b*, an inner annular portion 8*b* and a central aperture 9*b*. The two discs 6*a* and 6*b* of the protector 5 are joined together along their outer annular portions 7*a* and 7*b*. The discs 6*a* and 6*b* may be joined together by adhesives, glues, mechanical fasteners, or other means known in the art. The size of the two discs 6*a* and 6*b* depends upon the core size of the coil of material to be protected by the protector 5.

Figure 6:
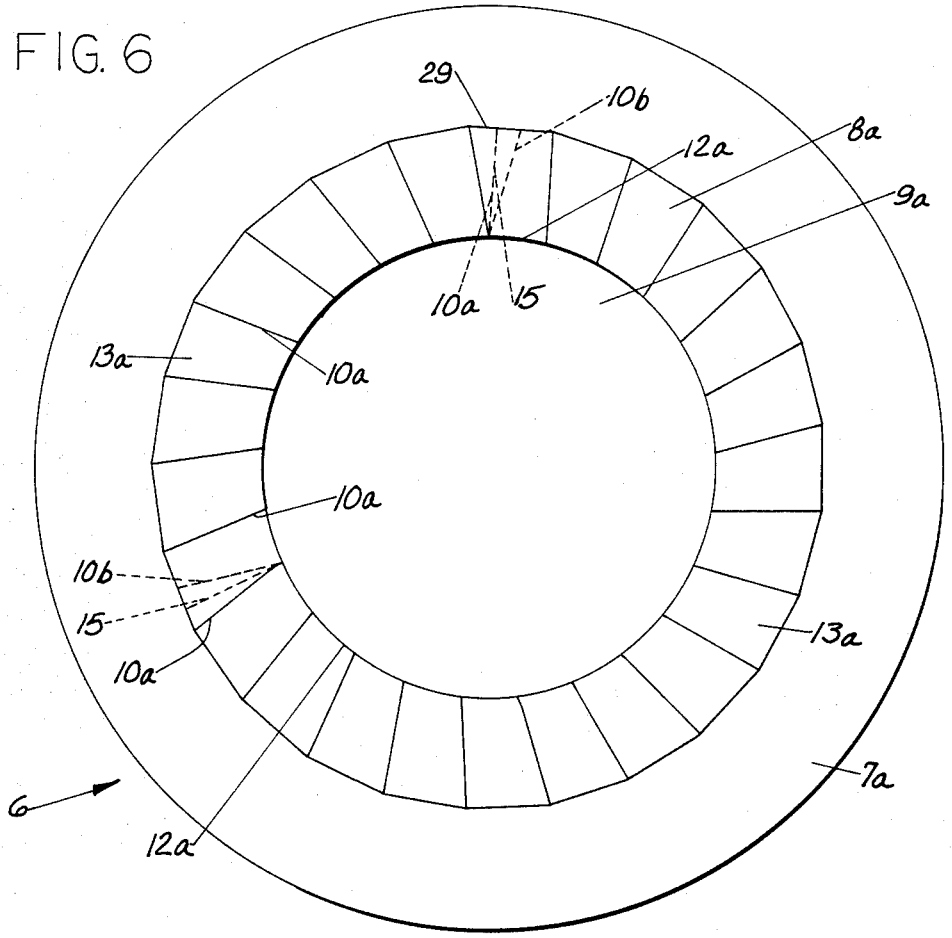
FIG. 6 is a plan view of one disc of the protector with the tabs positioned in the plane of the disc.

Reference is now made to FIG. 6. In this Figure disc 6*a* is shown in its initial unfolded state. It will be noted that the inner annular portion 8*a* is provided with a plurality of cuts 10*a* extending transversely thereof from the peripheral boundary 12*a* formed by the central aperture 9*a*. The cuts 10*a* are of the same length and divide the inner annular portion 8*a* into a plurality of substantially identical tabs 13*a*. As shown in FIG. 6, each cut 10*a* lies at an acute angle to an imaginary radial line 15 intersecting the peripheral boundary 12*a* at the same point as the cut. For each cut this angle is from about 5° to about 15° and preferably about 8°. The angularity and direction of each cut 10*a* of disc 6*a* is the same. The tabs 13*a* of disc 6 are capable of being bent along the circular bent line 29 at a substantially right angle relative to the outer annular portion 7*a* of disc 6*a*.

The disc 6*b* is similarly provided with a plurality of cuts extending from the peripheral boundary 12*b* (defined by central aperture 9*b* of disc 6*b*), transversely across the inner annular portion 8*b*. In this way a plurality of tabs 13*b* is formed on disc 6*b*. The tabs 13*b* differ from tabs 13*a* of disc 6*a* only in that the cuts which produced them lie at substantially the same but opposite or reverse angle to imaginary radial lines intersecting peripheral boundary 12*b* of disc 6*b* at the same points as the cuts.

Figure 5:
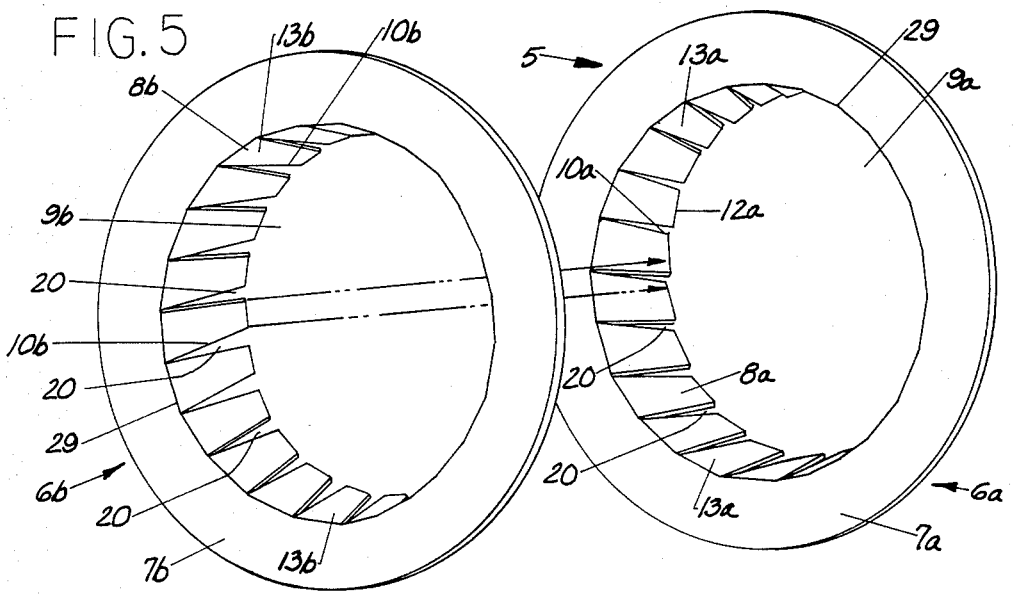
FIG. 5 is an exploded perspective view of the protector.

FIG. 5 clearly shows that the tabs 13*a* and 13*b* of the two discs 6*a* and 6*b* which compose each protector 5 are cut at reverse angles with respect to each other. Thus, the tabs 13*a* of disc 6*a* are cut along cut lines 10*a* to the left of the radial lines 15 (as viewed in FIG. 6). The tabs 13*b* of the second disc 6*b* are cut along cut lines to right of the radial lines 15. For purposes of explanation the cut lines for second disc 6*b* are shown in FIG. 6 in broken lines at 10*b*. The angle of the cut lines 10*b* relative to the radial lines 15 should be approximately the same as the angle of the cut lines 10*a*. It will be understood that the tabs 13*a* of disc 6*a* could be cut along cut lines 10*b* to the right of the radial lines 15, and the tabs 13*b* of disc 6*b* could be cut along cut lines 10*a* to the left of the radial lines 15, as viewed in FIG. 6. The key requirement is that all of the tabs of disc 6*a* of protector 5 are cut at a reverse angle to the angle of cut of all the tabs of the disc 6*b* of protector 5. As shown in FIG. 6, the main difference between the two cut lines 10*a* and 10*b* is the direction of cut, either left or right, relative to the radial lines 15.

Figure 1:
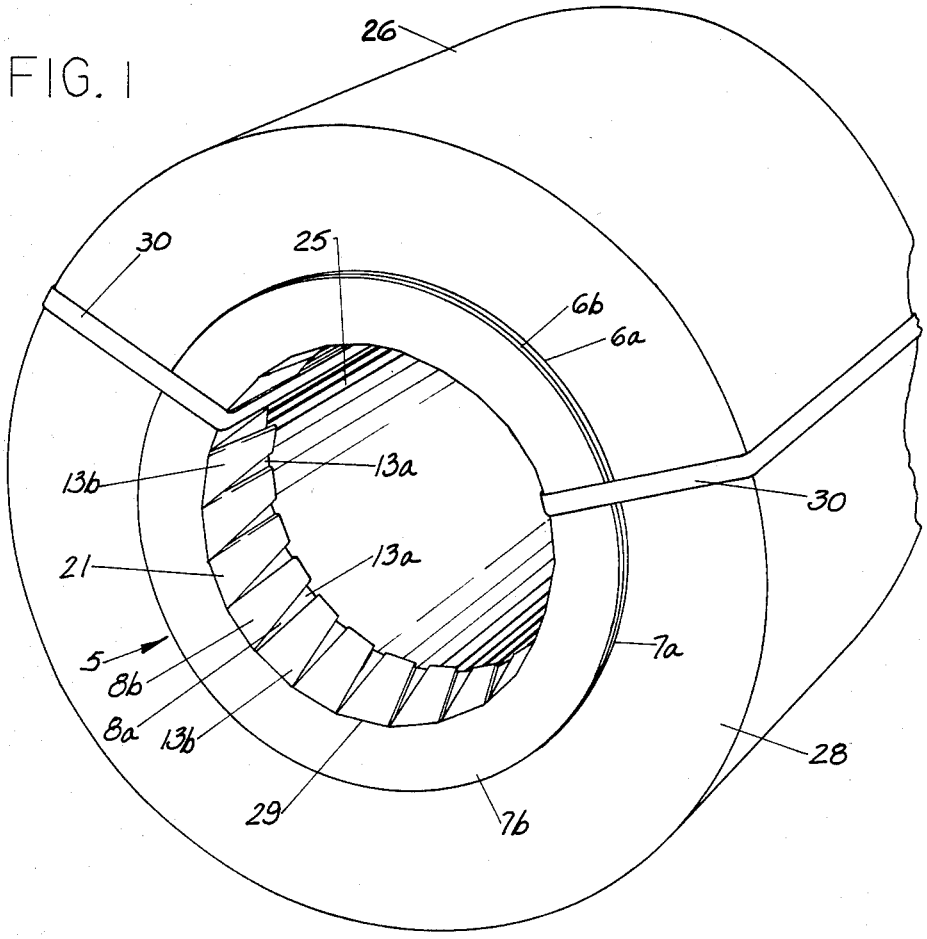
FIG. 1 is a perspective view of the protector of the present invention in place on a coil of material.
Figure 4:
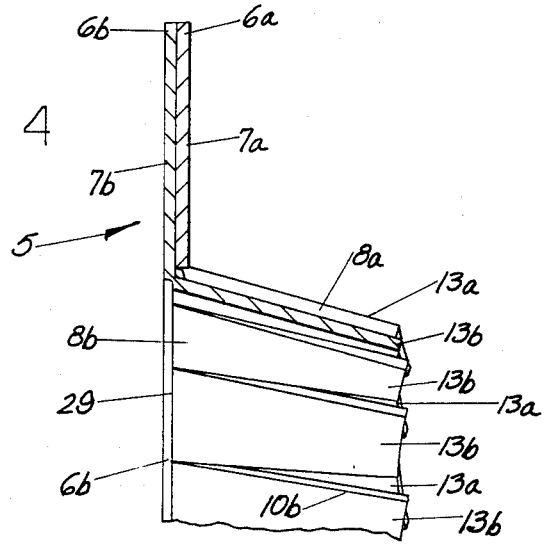
FIG. 4 is a fragmentary cross sectional view of the protector taken along section line 4—4 in FIG. 2.
Figure 2:
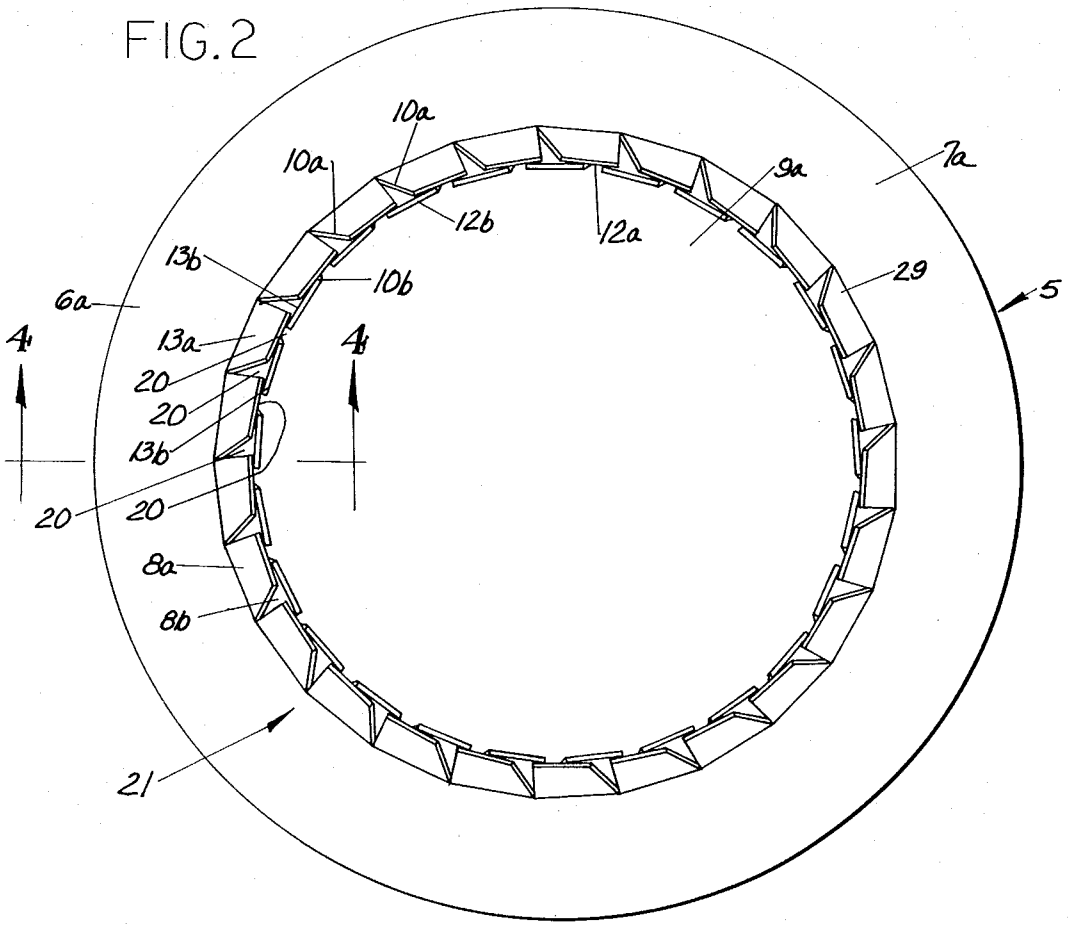
FIG. 2 is a plan view of the protector with its tabs bent upwardly.
Figure 3:
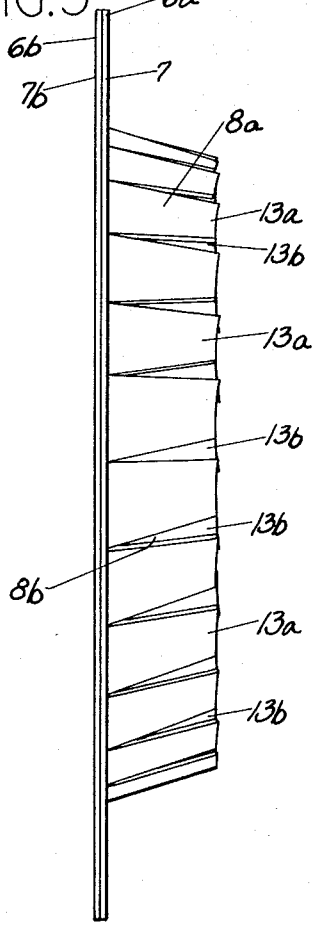
FIG. 3 is a side view of the protector of FIG. 3.

By cutting the tabs 13*a* of disc 6*a* at a reverse angle relative to the tabs 13*b* of disc 6*b* of each protector 5, tabs 13*a* and 13*b* lie in overlapping relationship to each other when the tabs 13*a* and 13*b* are positioned at a substantially right angle relative to their respective outer annular portions 7*a* and 7*b*. When the tabs 13*a* and 13*b* are in the position of use as shown in FIG. 2, namely at a substantially right angle relative to the outer annular portions 7*a* and 7*b*, the space 20 between each tab 13*a* on disc 6*a* is filled in by a tab 13*b* of the other disc 6*b* of the protector 5. In this manner, the tabs 13*b* on disc 6*b* of protector 5 eliminate the voids 20 between the tabs 13*a* of disc 6*a* and vice versa so as to provide a complete band 21 containing the two sets of tabs 13*a* and 13*b*. As shown in FIG. 1, this complete band 21 of tabs 13*a* and 13*b* allows the core 25 to be protected by the tabs 13*a* and 13*b* when the band 21 of tabs 13*a* and 13*b* is inserted into the core 25.

Preferably, the discs 6*a* and 6*b* are made from a solid fiberboard having a thickness of approximately 0.05 to 0.2 inches. Usually, the inner annular portions 8*a* and 8*b*, and thus the tabs 13*a* and 13*b* form about 25 to about 50% of their respective discs 6*a* and 6*b*. When first cut, the tabs 13*a* and 13*b* lie in the plane of their respective outer annular portions 7*a* and 7*b*. The tabs 13*a* and 13*b* are pliable and flexible relative to their respective outer annular portions 7*a* and 7*b*. After the cutting, as shown in FIG. 2, the tabs 13*a* and 13*b* are bent at an approximate right angle relative to their outer annular portions 7*a* and 7*b* to place the tabs 13*a* and 13*b* in their use positions. During the bending operation the tabs 13*a* and 13*b* shift oppositely (by virtue of the angularity of their cuts) to form the continuous band of tabs 21.

In use, two protectors 5 are applied to opposite ends of a coil of material with the bands of tabs of the protectors inserted into the coil core. In FIG. 1, one end of a coil 26 is illustrated showing a protector 5 mounted thereon with its band 21 of tabs 13*a* and 13*b* inserted into coil core 25. It will be apparent that the band 21 of tabs 13*a* and 13*b* will protect the core 25 from C-hooks or coil clamps (not shown), binding chains or bands 30, or the like. These devices will be spaced from the inner surface of the core 25 by the band of tabs of both protectors. The outer annular portions 7*a* and 7*b* of protector 5 will protect the edge and face portions of coil 26 and adjacent core 25. The same is true of the other protector (not shown) at the other end of coil 26.

In an alternative method of manufacturing the protector 5, the discs 6*a* and 6*b* have their inner annular portions 8*a* and 8*b* cut into substantially identical tabs 13*a* and 13*b* with the direction of the cut for both sets of tabs 13*a* and 13*b* being the same relative to the radial lines 15. Prior to joining the discs 6*a* and 6*b* together along their outer annular portions 7*a* and 7*b*, one of the discs is inverted so that the cut line of its tabs are opposite or reverse of the direction of cut in the tabs of the non-inverted disc. Upon this inversion, the tabs 13*a* will have an opposite direction of cut than the tabs 13*b* so as to allow the band 21 of tabs to be formed without any voids 20 upon the joining of the outer annular portions 7*a* and 7*b*.

Modifications may be made in the invention without departing from the spirit of it.

What is claimed is:

1. A protector for the core and adjacent edges and face portions of a coil of material, comprising first and second substantially identical circular discs each having an outer annular portion, an inner annular portion and a central circular aperture forming a circular inner edge, said outer annular portions of said first and second discs being joined together in superposed relationship, said inner annular portions of said first and second discs having cuts therein extending transversely thereof from said inner circular edges and forming a plurality of tabs capable of being bent at a substantially right angle to said outer annular portions, said cuts of said first disc each lying at the same acute angle to a radial line intersecting the same point as said cut on said circular inner edge of said first disc, said cuts of said second disc each lying at the same acute angle to a radial line intersecting the same point as said cut on said circular inner edge of said second disc, said angle of said cuts of said second disc being substantially equal to said angle of said cuts of said first disc and constituting the reverse thereof, said tabs of said first and second discs forming a continuous band when positioned at a substantially right angle to said outer annular portions, said continuous band of tabs being so sized as to be just nicely received in said core of said coil.

2. The protector as claimed in claim 1, wherein the discs are composed of a solid fiberboard.

3. The protector as claimed in claim 2 wherein each disc is approximately 0.05 to 0.2 inches thick.

4. The protector as claimed in claim 1, wherein said angles of said cuts of said first and second discs are within the range of 5° to 15°.

5. The protector claimed in claim 1, wherein said tabs of said first and second discs are so configured as to shift in opposite directions when bent at said substantially right angle to form said continuous band.

6. The protector as claimed in claim 1, wherein said outer annular portions of said first and second discs are joined together with an adhesive material.

7. The protector as claimed in claim 1, wherein said inner annular portion of each disc comprises approximately 25 to 50% of the width of each disc.

8. The protectors claimed in claim 1, wherein said outer annular portions of said first and second discs are joined together with glue.

9. The protector as claimed in claim 1, wherein said outer annular portions of said first and second discs are joined together with mechanical fastening means.

* * * * *